US008991813B2

(12) United States Patent
Fujiwara

(10) Patent No.: US 8,991,813 B2
(45) Date of Patent: Mar. 31, 2015

(54) SHEET TRANSPORT DEVICE

(71) Applicant: Takashi Fujiwara, Nagakute (JP)

(72) Inventor: Takashi Fujiwara, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/038,397

(22) Filed: Sep. 26, 2013

(65) Prior Publication Data

US 2014/0167347 A1 Jun. 19, 2014

(30) Foreign Application Priority Data

Dec. 14, 2012 (JP) ..... 2012-273467

(51) Int. Cl.
*B65H 5/00* (2006.01)
*B65H 7/02* (2006.01)
*B65H 5/06* (2006.01)

(52) U.S. Cl.
CPC . *B65H 7/02* (2013.01); *B65H 5/062* (2013.01)
USPC ..... 271/10.01

(58) Field of Classification Search
USPC ..... 271/10.01, 10.02, 10.03, 10.09; 399/124, 367, 371
See application file for complete search history.

(56) References Cited

U.S. PATENT DOCUMENTS

| | | | | |
|---|---|---|---|---|
| 7,099,619 | B2 * | 8/2006 | Choi | 399/367 |
| 7,900,908 | B2 * | 3/2011 | Sakakibara et al. | 271/10.01 |
| 8,042,802 | B2 * | 10/2011 | Shiraishi et al. | 271/171 |
| 2011/0148034 | A1 | 6/2011 | Inoue | |
| 2011/0242623 | A1 | 10/2011 | Akimatsu | |

FOREIGN PATENT DOCUMENTS

| | | | | |
|---|---|---|---|---|
| JP | 01127541 A | * | 5/1989 | B65H 7/12 |
| JP | 2011-130161 A | | 6/2011 | |
| JP | 2011-211480 A | | 10/2011 | |

* cited by examiner

*Primary Examiner* — Michael McCullough
(74) *Attorney, Agent, or Firm* — Banner & Witcoff, Ltd.

(57) ABSTRACT

A sheet transport device includes a sheet supporting surface which receives a plurality of sheets set thereon, a separation roller which separates the sheets set on the sheet supporting surface sheet by sheet to transport a separated sheet in a predetermined transport direction, and a first detection unit which is disposed to the supporting surface and detects whether a sheet is set on the sheet supporting surface. The separation roller and the first detection unit are disposed to be separated at least in a sheet width direction orthogonal to the predetermined transport direction, and a distance between the first detection unit and an end edge of the separation roller at a side of the first detection unit is longer than a short side of a non-allowable sheet which is smaller than a minimum sheet size within an allowable transport range set in the sheet transport device.

9 Claims, 10 Drawing Sheets

SHEET TRANSPORT DEVICE

CROSS-REFERENCE TO RELATED APPLICATION

This application claims priority from Japanese Patent Application No. 2012-273467, filed on Dec. 14, 2012, the entire subject matter of which is incorporated herein by reference.

TECHNICAL FIELD

Aspects of the present invention relates to a sheet transport device which reads an image on a sheet while transporting the sheet along a predetermined transport path.

BACKGROUND

There has been known a sheet transport device configured to read an image on a sheet using a reading unit while transporting the sheet along a predetermined transport path.

The sheet transport device separates a plurality of sheets set on a sheet supporting surface sheet by sheet, transports a separated sheet, and reads an image on the sheet during the transporting process.

In this type of sheet transport device, a size of a sheet which can be read by the sheet transport device is set as specification in advance. In other words, a maximum sheet size and a minimum sheet size of a sheet which can be transported in the transport path is set as specifications. In many cases, the maximum sheet size and the minimum sheet size, in particular, the minimum sheet size is determined by a distance of arrangement of transport roller pairs in a transport direction which are arranged at a plurality of positions on the transport path to transport the sheet.

In other words, in many cases, there is employed a method in which a driving roller and a driven roller of the transport roller pair nip a sheet to transport the sheet. In this configuration, in order to appropriately transport a sheet, it is necessary to pass the sheet from a nip portion of the transport roller pair arranged at an upstream side of the transport path to a nip portion of a subsequent transport roller pair arranged at a downstream side. Therefore, it is necessary that the transport roller pairs are arranged within a distance allowing the passing of the sheet and the sheet is laid across at least two of the nip portions at the upstream side and the downstream side.

When a user accidentally or forcibly sets a sheet smaller than the minimum sheet size set as specifications of the device on a sheet supporting surface, performs a reading start operation, and starts the transporting of the sheet, there could be a concern, for example, that the passing of the sheet cannot be performed and the transporting of the sheet is stopped at a middle of the transport path. When the transporting of the sheet is stopped in the middle of the transport path, it is difficult to take out the sheet.

SUMMARY

Accordingly, an aspect of the present invention provides a sheet transport device which may suppress forcible or accidental setting and transporting of a sheet smaller than a set minimum sheet size.

According to an illustrative embodiment of the present invention, there is provided a sheet transport device including a sheet supporting surface configured to support one or more sheets thereon, a separation roller configured to separate, one by one, the one or more sheets supported by the sheet supporting surface to transport a separated sheet in a predetermined transport direction, and a first detection unit disposed to the sheet supporting surface and configured to detect whether a sheet is set on the sheet supporting surface. The separation roller and the first detection unit are disposed to be separated at least in a sheet width direction orthogonal to the predetermined transport direction. A distance between the first detection unit and an end edge of the separation roller at a side of the first detection unit is longer than a short side of a non-allowable sheet which is smaller than a minimum sheet size within an allowable transport range set in the sheet transport device.

According to the above configuration, the sheet transport device may suppress forcible or accidental setting and transporting of a sheet smaller than a set minimum sheet size.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1:
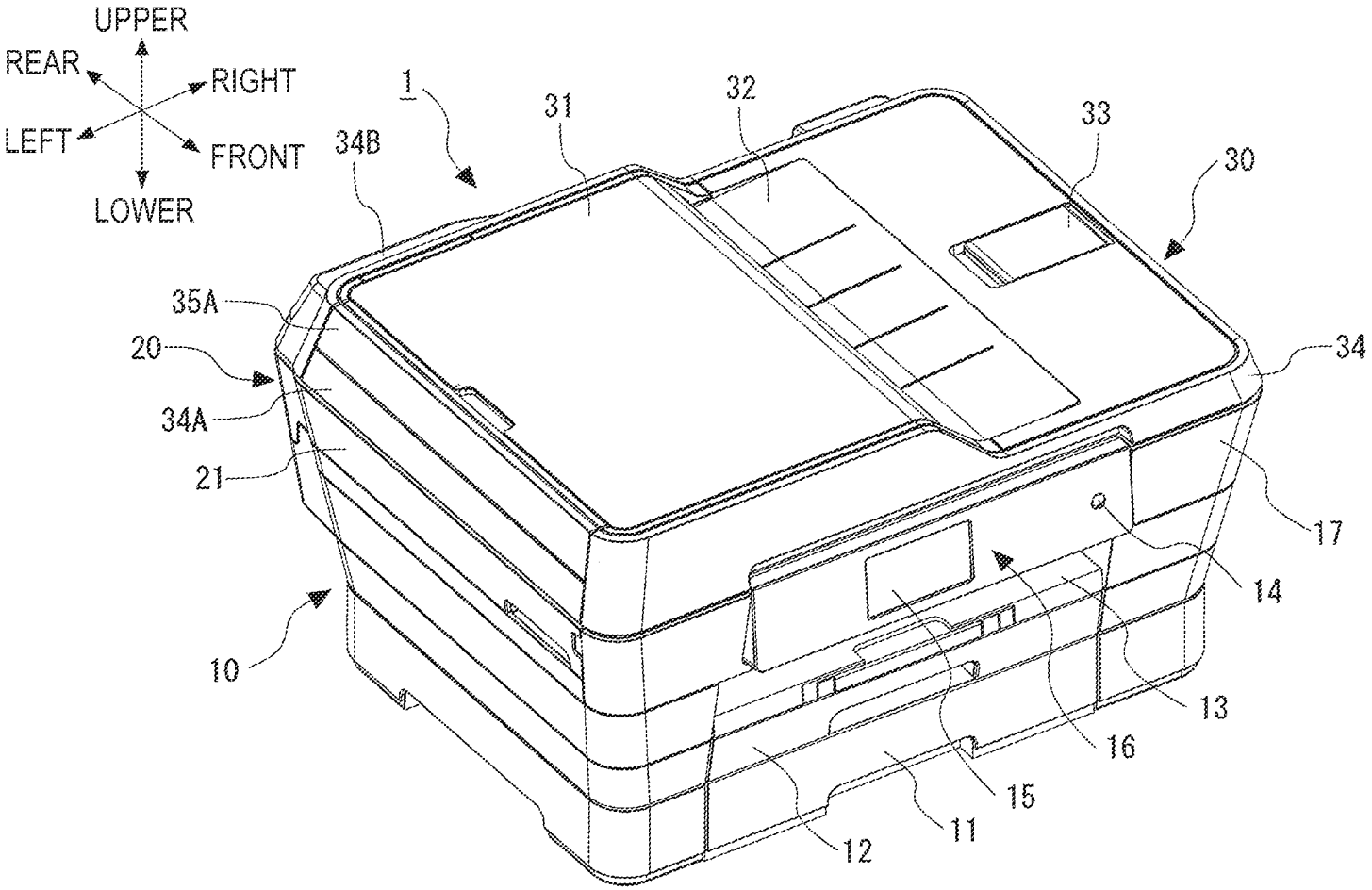
FIG. 1 is a perspective view of a multifunction printer mounted with a sheet transport device according to an illustrative embodiment of the present invention.

Hereinafter, a sheet transport device according to an illustrative embodiment of the present invention, which is applied to a multifunction printer, will be described while referring to the accompanying drawings. The sheet transport device exemplified in the illustrative embodiment is configured as a part of the multifunction printer which has not only an image reading function (scanning function) but also other functions (for example, printing function, copying function, and facsimile transmission/reception function). Also, the illustrative embodiment shown hereinbelow is a preferred specific example of the sheet transport device of the present invention and there are cases in which various technically preferable limitations are given thereto, but the scope of the present invention is not limited to these aspects unless stated to limit the present invention. Further, components of the illustrative embodiment shown hereinbelow may be appropriately replaced by existing components, and various variations, including a combination with other existing components, may be made.

Specifically, there is no limitation in combining the various functions of the multifunction printer with each other and in providing additional functions by using options or the like (for example, a sheet feed cassette). Also, the maximum size (for example, A4 or A3) and the minimum size (for example, postcard size or business card size) of sheets (documents) which is allowed for the sheet transport function may be arbitrarily set. Therefore, the illustrative embodiment shown hereinbelow does not limit the contents of the invention described in the claims. The description hereinbelow will be based on the upper-lower, left-right, and front-rear directions shown in the drawings so as to facilitate the understanding of the relative positional relationship between parts of the multifunction printer. Also, each of the directions is defined on the assumption that the standing position of a user is the front side of the device.

[External Configuration of Multifunction Printer]

Figure 2:
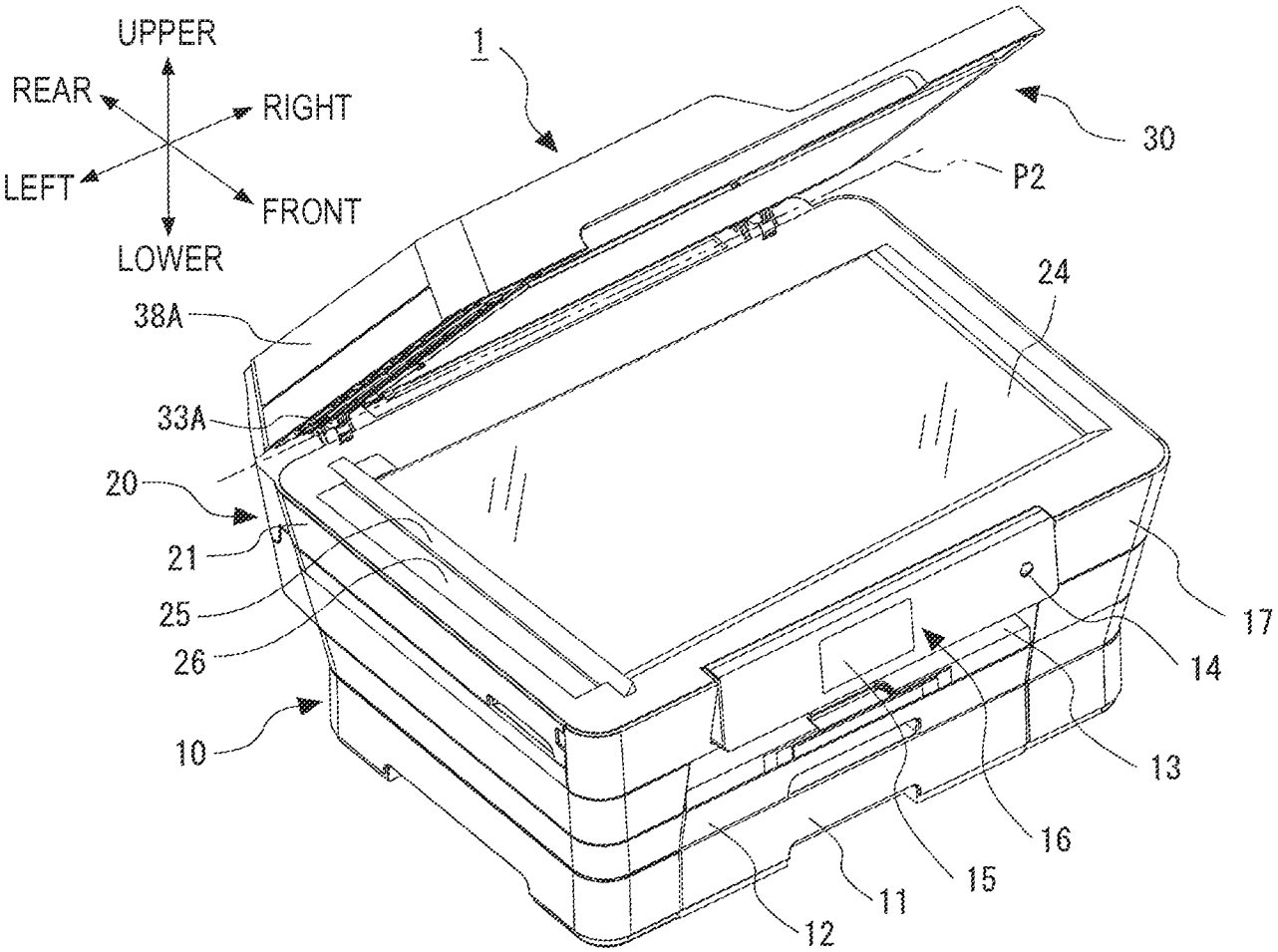
FIG. 2 is a perspective view of the multifunction printer in a state where the sheet transport device mounted with a sheet transport unit is opened.

Referring to FIG. 1 and FIG. 2, a multifunction printer 1 includes a main body unit 10, a reading unit 20 which is arranged on an upper part of the main body unit 10, and a sheet transport unit 30 (example of a sheet transport device) which is arranged on an upper part of the reading unit 20. An image forming unit (not shown) is accommodated by the main body unit 10.

[Configuration of Main Body Unit 10]

The main body unit 10 includes drawer-type recording sheet accommodating cassettes 11 and 12 which are arranged in two in the upper-lower direction, and an outlet 13 which is opened at an upper part of the recording sheet accommodating cassettes 11 and 12 and used to discharge recording sheet after an image forming process by the image forming unit. Also, over the outlet 13 and at a front surface side of the main body unit 10, there is disposed an operation unit 16 including a switch 14 which is used for a user to input various instructions to the multifunction printer 1, and a touch panel-type liquid crystal display panel 15.

The recording sheet accommodating cassettes 11 and 12 may accommodate recording sheet of different sizes (for example, A4 size and A3 size, and the like). Also, the lower recording sheet accommodating cassette 11 is expandable by an option or the like, and also there is a case in which the lower recording sheet accommodating cassette is not disposed. The outlet 13 is an opening which is used to discharge the recording sheet after the image forming process, and, for example, may be a known sheet feed and discharge port which allows the manual feed of postcards and the like. The operation unit 16 may be arranged with, for example, known numeric keys and button-type switches such as mode selection switches for various functional modes (scanning function, printing function, copying function, facsimile transmission and reception function, and the like) of the multifunction printer 1 in combination with the liquid crystal display panel 15. Further, in the illustrative embodiment, the operation unit 16 is arranged on a front cover 17 which is the upper part of the main body unit 10. The front cover 17 is also used as a front cover of the reading unit 20. Therefore, the front cover 17 may be integrally configured with a circumferential wall 21 of the reading unit 20 and the operation unit 16 may be arranged in the reading unit 20.

The main body unit 10 includes driving mechanisms which are necessary to perform the various functional modes of the multifunction printer 1, and a control unit (not shown) which controls the driving mechanism. The control unit controls not only the driving mechanisms arranged in the operation unit 16 and the main body unit 10 but also the various driving mechanisms disposed in the reading unit 20 and the sheet transport unit 30. The driving mechanisms of the reading unit 20 and the sheet transport unit 30 may be subject to another control unit which may be interface-connected with the control unit of the main body unit 10 to ensure the convenience of option installation, unit exchange, and the like.

Within the main body unit 10, a drive motor which drives a recording sheet transport mechanism portion which is used to discharge and transport the recording sheet accommodated in the recording sheet accommodating cassettes 11 and 12 through a sheet feed and discharge path reaching a sheet discharge port 13, the image forming unit which is arranged in the transport path, various sensors which detect the transport timing and jamming of the recording sheet in the sheet feed and discharge path, and the like are arranged to be controlled by the control unit. Known techniques may be employed in the specific configurations and control examples thereof, and thus the description will be omitted herein.

[Configuration of Reading unit 20]

The reading unit 20 has a structure openable and closable with respect to the main body unit 10, and the pivot center thereof is the axis (not shown) extending in the left-right direction at a rear surface side (rear side shown in FIG. 1) of the main body unit 10 and the reading unit 20.

When the reading unit 20 is displaced to an open position, an upper surface side of the main body unit 10 is opened, and maintenance works may be performed on each part, such as the image forming unit, built into the main body unit 10 although not shown in detail.

The reading unit 20 is surrounded at four sides by the circumferential wall 21, and. As shown in FIG. 2, the reading unit 20 includes a first platen 22 formed of a transparent glass or the like, an abutting member 23 along one edge of the first platen 22, and a second platen 24 formed of transparent glass or the like and arranged at the opposite side from the first platen 22 with respect to the abutting member 23 on an upper surface thereof.

The first platen 22 is used as a supporting surface which supports a still document, and the abutting member 23 is used in the positioning of the document when the user supports the fixed document with the first platen 22. Also, the second platen 24 is used to read the sheets by using the sheet transport unit 30. The first platen 22 has a rectangular shape extending in the front-rear and left-right directions, and the size thereof is larger than the size at which a document having the maximum document size (for example, A3 size) which is readable by the device can be supported. The first platen 22 and the second platen 24 may be integrally formed, and the abutting member 23 may be arranged on upper surfaces thereof by adhesion or the like.

Figure 3:
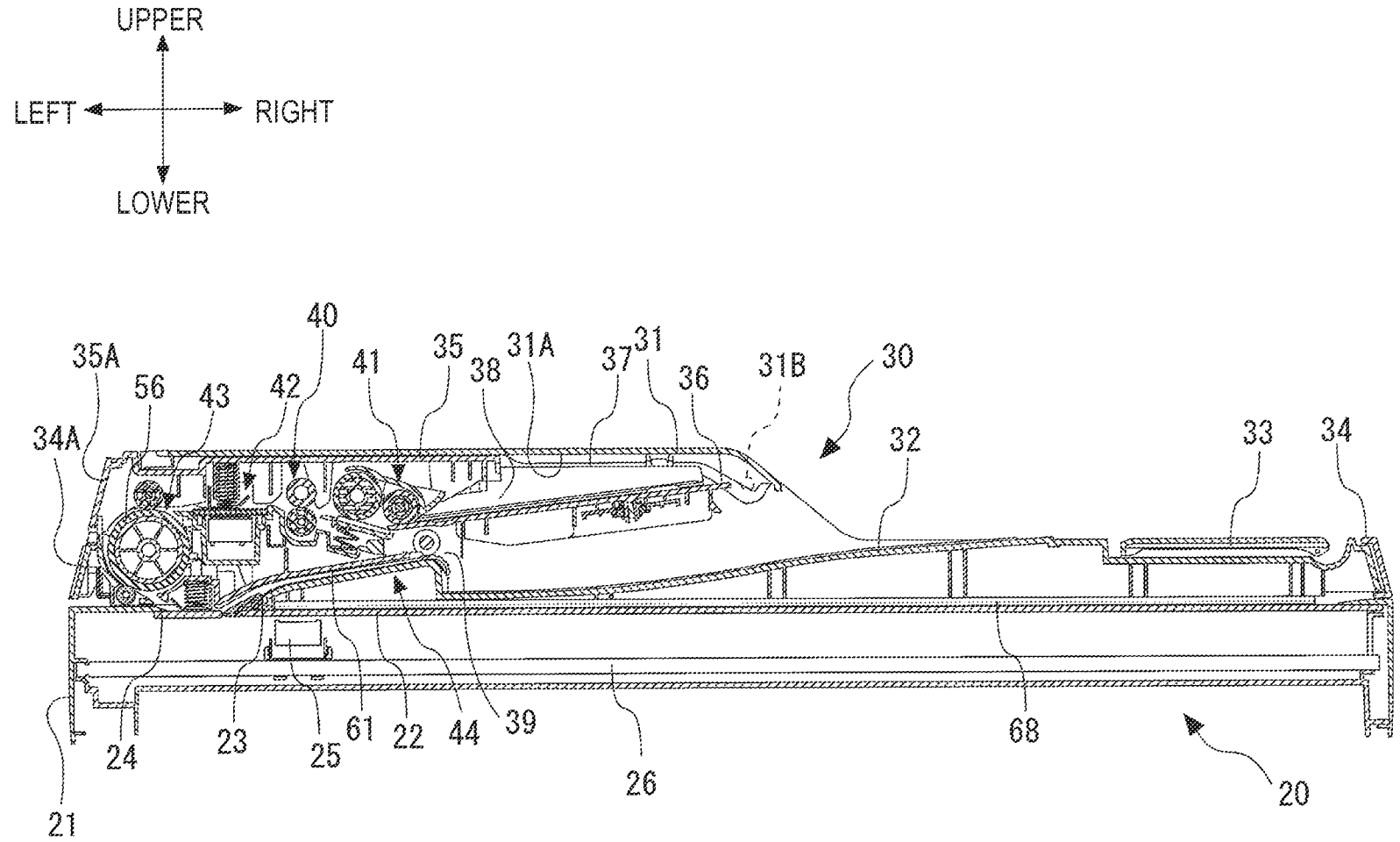
FIG. 3 is a cross-sectional view showing a state where a sheet supporting cover of the sheet transport device is closed.
Figure 4:
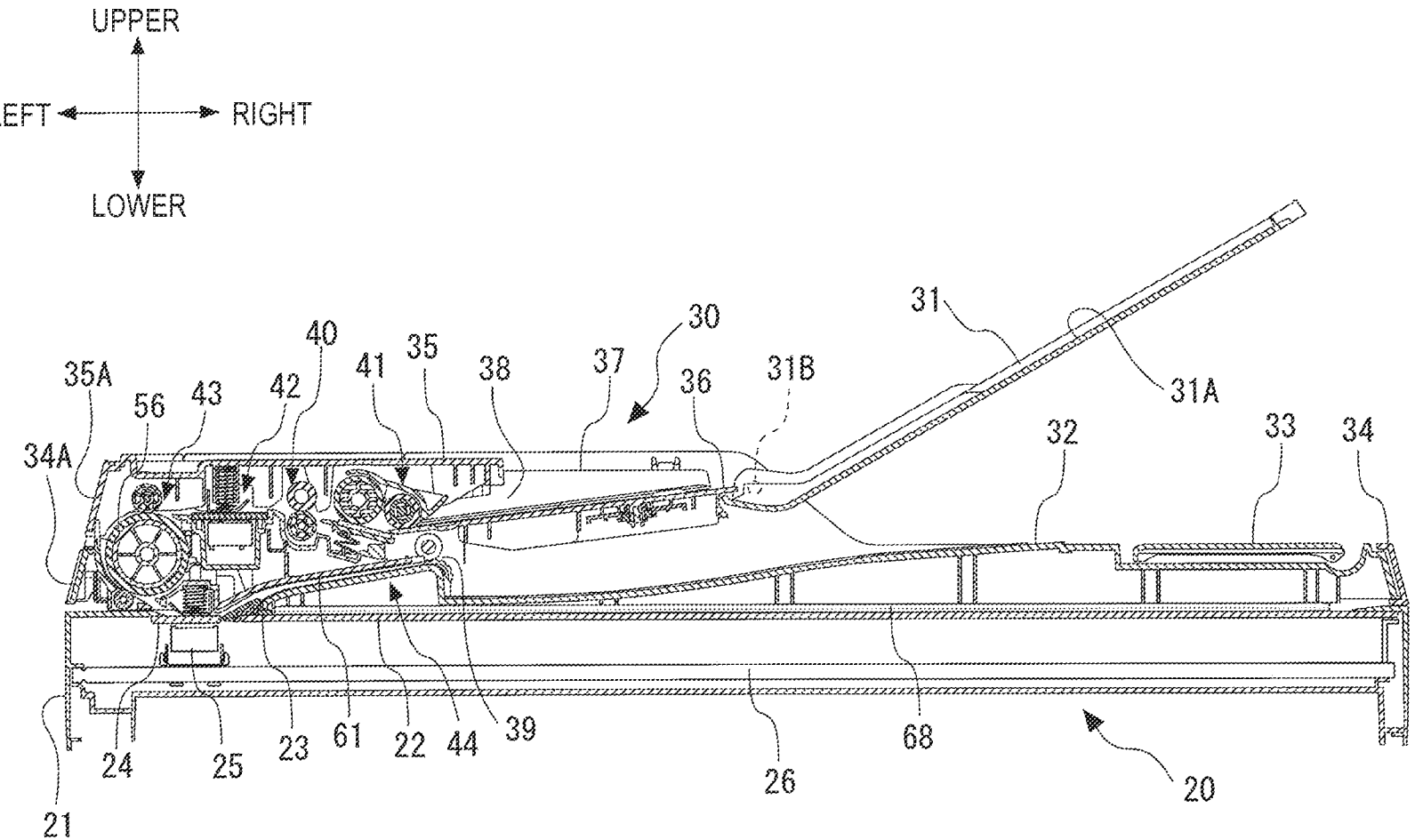
FIG. 4 is a cross-sectional view showing a state where the sheet supporting cover of the sheet transport device is opened.

As shown in FIG. 3 and FIG. 4, a movable reading sensor 25 is arranged in a movable manner below the first platen 22 and the second platen 24. The movable reading sensor 25 reciprocates by the driving of a moving motor, which is not shown, along a guide shaft 26 spanning in the left-right direction in an inner space surrounded by the circumferential wall 21 of the reading unit 20. When the image on the sill document is read, the movable reading sensor 25 moves in the left-right direction (sub-scanning direction) within the reading unit 20 along a lower surface side of the first platen 22 as shown in FIG. 3 to read the image on the still document. Also, when the image on the sheet transported by the sheet transport unit 30 is read, the movable reading sensor 25 moves to a position facing the second platen 24 as shown in FIG. 4, and reads the image on the sheet transported by the transport unit 30 at that position. The movable reading sensor 25 reads the image upward while the first platen 22 and the second platen 24 are arranged over the movable reading sensor 25.

[Configuration of Sheet Transport Unit 30]

As shown in FIG. 2, the sheet transport unit 30 has a structure openable and closable with respect to the reading unit 20, and the pivot center thereof is an axis P extending in the left-right direction at a back surface side of the reading unit 20 and the sheet transport unit 30. Therefore, the sheet transport unit 30 may be displaced to a closed position as shown in FIG. 1, that is, a state where the upper surface of the reading unit 20 having the first platen 22 is covered (closed state) and to the open position as shown in FIG. 2, that is, a state where the upper surface of the reading unit 20 having the first platen 22 is exposed (open state). In a case where the sheet transport unit is at the closed position, the sheet transport unit 30 functions as a document cover which covers the first platen 22 and a sheet which is a reading object supported by the first platen 22.

As shown in FIG. 1, the sheet transport unit 30 is arranged with a sheet supporting cover 31 to the left from around the center of the upper surface, a sheet discharge tray 32 to the right from around the center of the upper surface, and an extension tray 33 near a right end of the upper surface. The sheet transport unit 30 is surrounded at four sides by the frame wall 34, and the frame wall 34 is formed by assembling a plurality of divided panels. In the illustrative embodiment, a left side surface portion is further divided vertically into a lower panel portion 34A and an upper panel portion 35A. Also, a driving unit cover portion 34B is mounted on a rear surface of the sheet transport unit 30.

Figure 5:
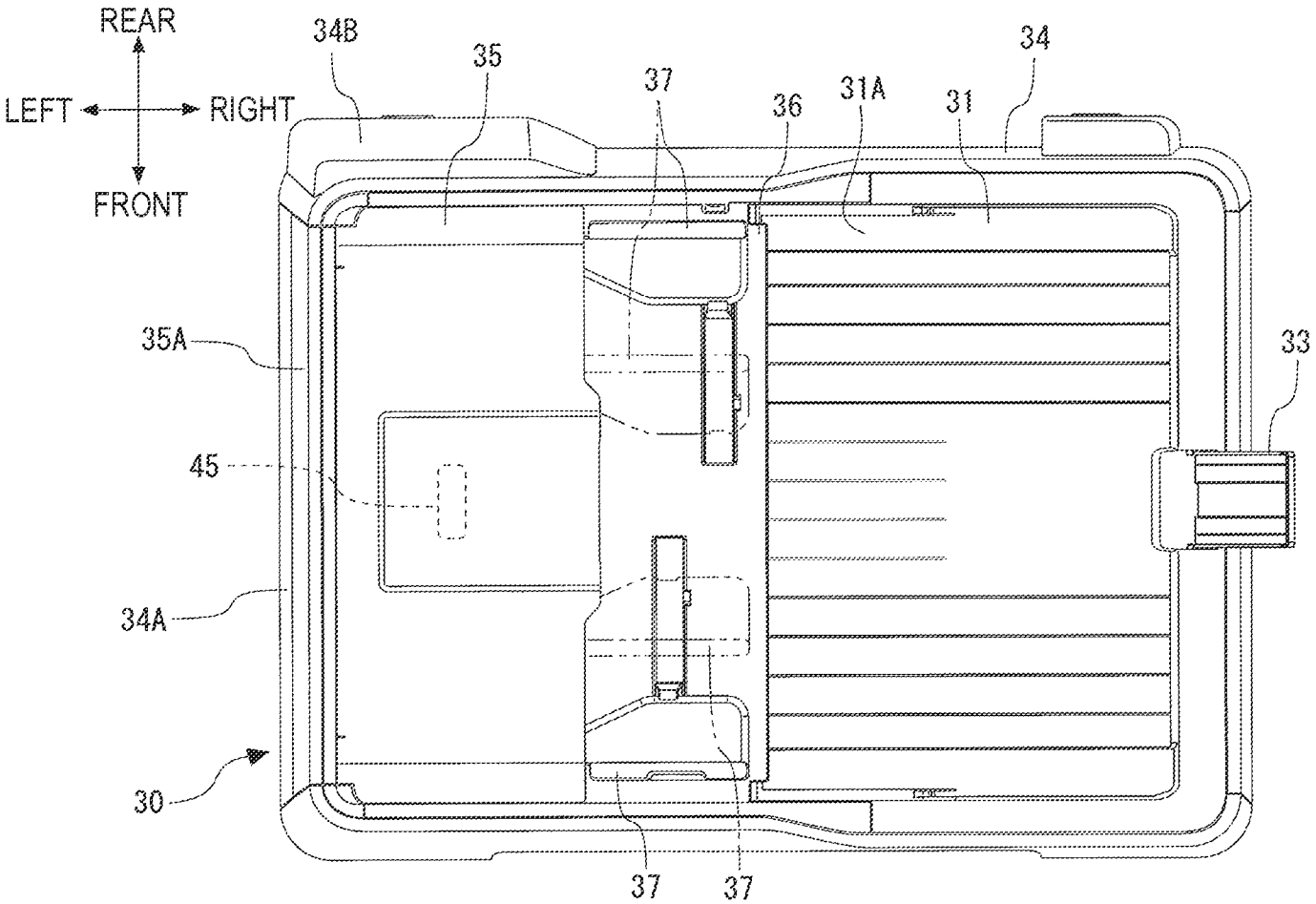
FIG. 5 is a plan view showing a state where the sheet supporting cover and an extension tray of the sheet transport device are opened.

The sheet supporting cover 31 may be displaced to the closed state shown in FIG. 3 in which a left side from the center in the left-right direction of the sheet transport unit 30 is covered and the open state shown in FIG. 4 and FIG. 5 in which the transport sheet supporting surface 31A is exposed. The sheet supporting cover 31 is pivotably attached to the sheet transport unit 30 using a pivot shaft 31B which is engaged in the front-rear direction with a cover member (not shown) placed inside the frame wall 34 near the center in the left-right direction of the sheet transport unit 30 as a fulcrum. When the sheet supporting cover 31 is in the opened state, the sheet transport function may be used as an automatic document feeder (ADF). Therefore, when the sheets are held by the transport sheet supporting surface 31A, the sheet supporting cover 31 is in the opened state with an inclination in which the pivot shaft 31B side is down forward and the free end side is up rearward. Also, when the sheet supporting cover 31 is in the opened state, an ADF cover 35 integrally having the upper panel portion 35A and a sheet guide surface 36 are exposed. On the sheet guide surface 36, a pair of sheet guide members 37 which support both side edges along the transport direction of the sheets held by the transport sheet supporting surface 31A are arranged. The pair of sheet guide members 37 suppress skew transport by guiding both side edges of the sheets held by the transport sheet supporting surface 31A. For example, relative approach and separation may be made between a position corresponding to the width of the maximum allowable size (for example, A3 vertical) set in advance using the main body unit 10 or the sheet transport unit 30 as shown with the solid line in FIG. 5 and a position corresponding to the width of the minimum allowable size (for example, postcard horizontal) shown with the chain line in FIG. 5.

Between the transport sheet supporting surface 31A and the ADF cover 35, a sheet feed inlet 38 for the sheet is formed. Between the transport sheet supporting surface 31A and the sheet discharge tray 32, a sheet discharge port 39 for the sheet is formed.

Figure 6:
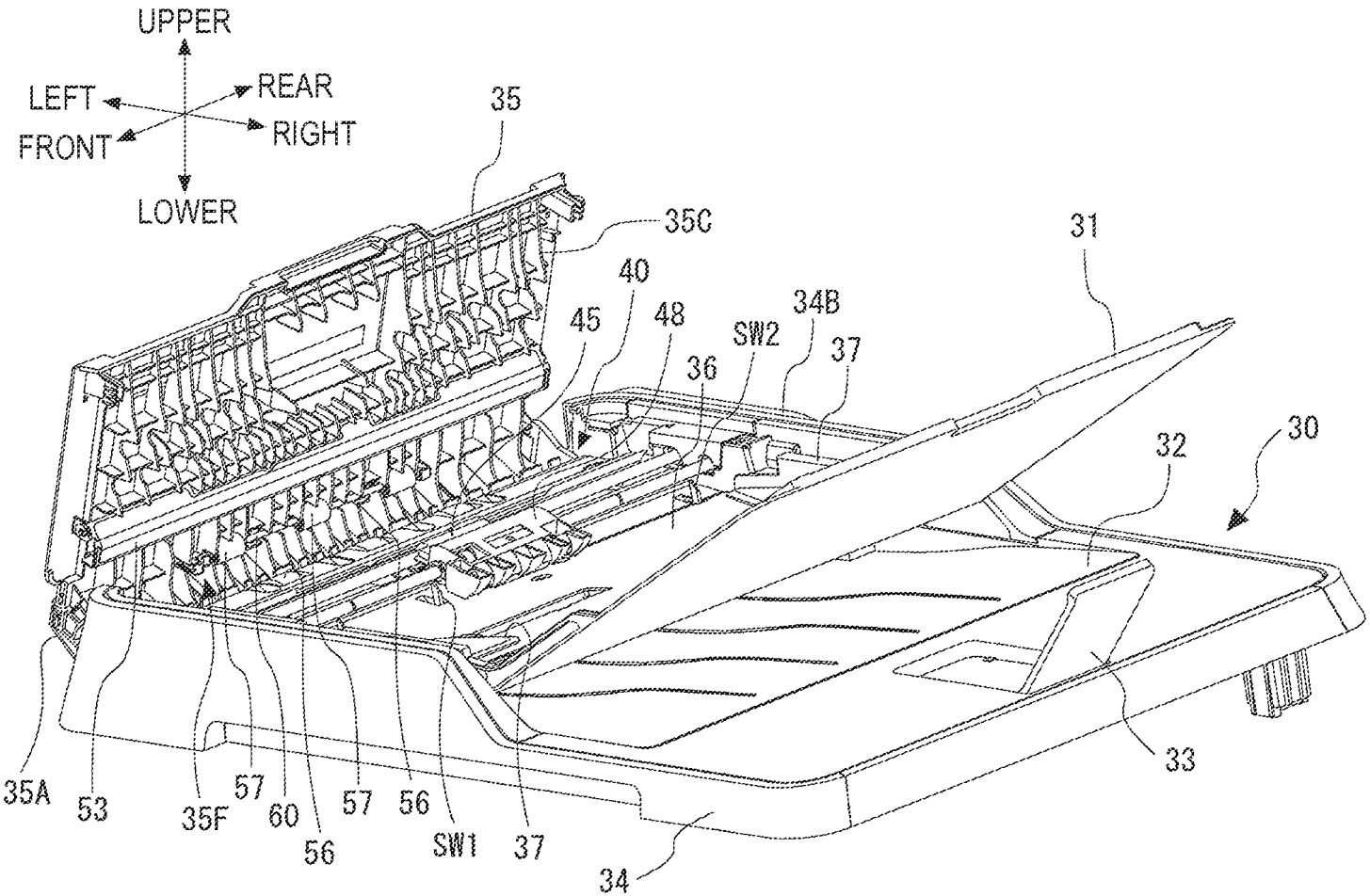
FIG. 6 is a perspective view showing a state where the sheet supporting cover, an ADF cover, and the extension tray of the sheet transport device are opened.

In a normal state, the ADF cover 35 covers the sheet transport portion 40 from the sheet feed inlet 38 to the sheet discharge port 39 from above. When maintenance is performed or sheet jamming or the like occurs, the sheet transport portion 40 is opened upward as shown in FIG. 6. The ADF cover 35 may be an attachable and detachable type instead of a pivoting type as long as the sheet transport portion 40 placed therebelow can be opened.

[Overall Configuration of Sheet Transport Portion 40]

Next, the specific configuration of the sheet transport portion 40 will be described while referring to FIG. 7. In the description below, the sheet transport direction is referred to as a downstream side based on the sheet transport direction (refer to the thick two-dot chain line) and the opposite side is referred to as an upstream side.

The sheet transport portion 40 includes a sheet feed unit 41 which is arranged at the downstream side of the sheet feed inlet 38, a fixed reading unit 42 which is arranged at the downstream side of the sheet feed unit 41, a U-turn transport unit 43 which is arranged at the downstream side of the fixed reading unit 42, and a discharge unit 44 which is arranged at the downstream side of the U-turn transport unit 43 to reach the sheet discharge port 39.

[Configuration of Sheet Feed Unit 41]

The sheet feed unit 41 performs sheet feed toward the downstream side while separating, one by one, the sheets set in a face-up state on the transport sheet supporting surface 31A (sheet guide surface 36) sheet by sheet from the uppermost one. The sheet feed unit 41 includes a sheet feed roller 45, a separation roller 46, a separation pad 47, a swinging holder 48, and a relay roller pair 49, a front sensor SW1 (example of a first detection unit), and a maximum sheet sensor SW2.

The sheet feed roller 45 is rotation-driven at a position along the sheet guide surface 36 at the transport direction upstream side of the sheet feed unit 41. The sheet feed roller 45 is rotation-driven in a predetermined direction (clockwise direction in FIG. 7), that is, a direction in which the sheets are drawn to the separation roller 46 by transmitting the driving force of a transport motor (not shown) of a known driving transmission mechanism. In this manner, the sheet feed roller 45 feeds the sheets set on the transport sheet supporting surface 31A toward the separation roller 46.

The separation roller 46 is rotatably supported to a frame, which is not shown, at the transport direction downstream side from the sheet feed roller 45. The separation roller 46 is rotated in the same direction as the sheet feed roller 45 by the power transmission caused by the driving of the transport motor.

The separation pad 47 is arranged at a position facing the separation roller 46. The separation pad 47 is biased by a biasing spring 50 toward an outer circumferential surface of the separation roller 46. In this manner, the separation roller 46 operates together with the separation pad 47 and separates only the uppermost sheet in contact with the separation roller 46 from the other sheets to transport the uppermost sheet toward the downstream side.

The swinging holder 48 is supported by a rotating shaft 46A of the separation roller 46 via a bearing, which is not shown. The swinging holder 48 extends from the rotating shaft 46A of the separation roller 46 toward the transport direction upstream side, and rotatably supports the sheet feed roller 45. The swinging holder 48 is swung about the rotating shaft of the separation roller 46 by the power transmission from the transport motor.

At the transport direction downstream side of the sheet feed unit 41, the relay roller pair 49 transports the sheet after the separation toward the fixed reading unit 42. The number of the relay roller pair 49 may be increased or decreased depending on the length of the transport path corresponding to the allowable size set in advance, for example, in the main body unit 10 and the sheet transport unit 30.

The front sensor SW1 has a tip end projecting from an upper surface of the sheet guide surface 36 at a position close to the swinging holder 48, and detects the setting of the sheet on the transport sheet supporting surface 31A by detecting a tip end (lower end) of the sheet set on the transport sheet supporting surface 31A. The maximum sheet sensor SW2 has a tip end projecting from the upper surface of the sheet guide surface 36 near an end portion (or near both ends) of the sheet guide surface 36 at the opposite side of the front sensor SW1 with respect to the swinging holder 48, and detects that the sheet set on the sheet supporting surface 31A is a document having a maximum sheet size. The maximum sheet sensor SW2 is used when automatically selecting which size of the recording sheet accommodated in the recording sheet accommodating cassettes 11 and 12 for the copying function.

[Configuration of Fixed Reading Unit 42]

If necessary, the fixed reading unit 42 reads the image on the sheet that is transported from the sheet feed unit 41. The fixed reading unit 42 is arranged in a portion of the linear-shaped path at the transport direction downstream side than the relay roller pair 49 and at the upstream side than the U-turn transport unit 43. The fixed reading unit 42 includes a fixed reading sensor 51, a third platen 52, a sheet pressing member 53 which faces the fixed reading sensor 51 across the third platen 52, and a biasing spring 54 which biases the sheet pressing member 53 toward the third platen 52, and a holder 55 which holds the fixed reading sensor 51 and the third platen 52.

A contact image sensor (CIS) is used in the fixed reading sensor 51. The fixed reading sensor 51 is arranged with a reading surface of the image directed upward. The reading range of the fixed reading sensor 51 in a main scanning direction (front-rear direction) is the length corresponding to a short side of the A3 size. Herein, the sheet which is transported by the relay roller pair 49 passes between the third platen 52 which faces the reading surface of the fixed reading sensor 51 and the sheet pressing member 53, and the sheet is transported while being pressed to the third platen 52 side by the sheet pressing member 53. The fixed reading sensor 51 reads the image on a back surface of the passing sheet in a case where the sheet has images on both sides.

The holder 55 holds the third platen 52 in a state where the fixed reading sensor 51 is received, and holds a pinch roller 49A of the relay roller pair 49, the separation pad 47, and the biasing spring 50 to form these into an unit. The separation pad 47 is held displaceably by the holder 55 via a spring cover 56A.

[Configuration of U-Turn Transport Unit 43]

The U-turn transport unit 43 includes a main transport roller 56, a pinch roller 57, and a pinch roller 58 so as to form a U-turn transport path 59.

The main transport roller 56 is rotatably supported by a frame, which is not shown, placed inside the lower panel portion 34A, and is rotation-driven by the sheet feed motor or an additional drive motor (not shown). In the illustrative embodiment, the range of approximately one-half to the left of an outer circumferential surface of the main transport roller 56 is used as the U-turn transport path 59. The pinch roller 57 is arranged near an upper end of the main transport roller 56 to be in contact with the main transport roller 56. The pinch roller 58 is arranged to be in contact with the main transport roller 56 from the lower left of the main transport roller 56. Also, at a position which faces the main transport roller 56, a plurality of guide ribs 35C which project from an inner surface 35B of the ADF cover 35 toward the main transport roller 56 side and extend in a direction along the transport direction and a guide surface 34D which bends and extends inside from the lower panel portion 34A and is shaped along the outer circumferential surface of the main transport roller 56 are arranged. Therefore, the guide ribs 35C and the guide surface 34D form the U-turn transport path 59 so as to face the main transport roller 56 with a gap. Also, the guide ribs 35C fix a shaft 60 of the pinch roller 57.

[Configuration of Discharge Unit 44]

The discharge unit 44 includes a guide panel 61 which spans in a range reaching the vicinity of the sheet discharge port 39 from a position which faces near a lower end of the main transport roller 56 at the transport direction downstream side than the pinch roller 58, a lower guide panel portion 32A which extends so as to face the guide panel 61 with a gap to form a sheet discharge path 62, a sheet discharge roller 63, and a pinch roller 64 which faces the sheet discharge roller 63. The lower guide panel portion 32A integrally has the sheet discharge tray 32 which is placed at the downstream side.

An upstream end side of the guide panel 61 is arranged with a sheet pressing member 65 which faces an upper surface of the second platen 24, and a biasing spring 66 which biases the sheet pressing member 65 toward the second platen 24. Also, the abutting member 23 (refer to FIG. 2) is placed at a position of the guide panel 61 and specifically, at an upstream end of the downstream side lower guide panel portion 32A. Further, a sheet pad 68 which has a white sheet 67 is attached to a surface of the lower guide panel portion 32A of the sheet discharge tray 32 at an area facing the first platen 22. The sheet pad 68 presses the sheet which is supported by the first platen 22 from above.

[Relationship of Arrangement of Front Sensor SW1 and Rear Sensor SW3]

Figure 8:
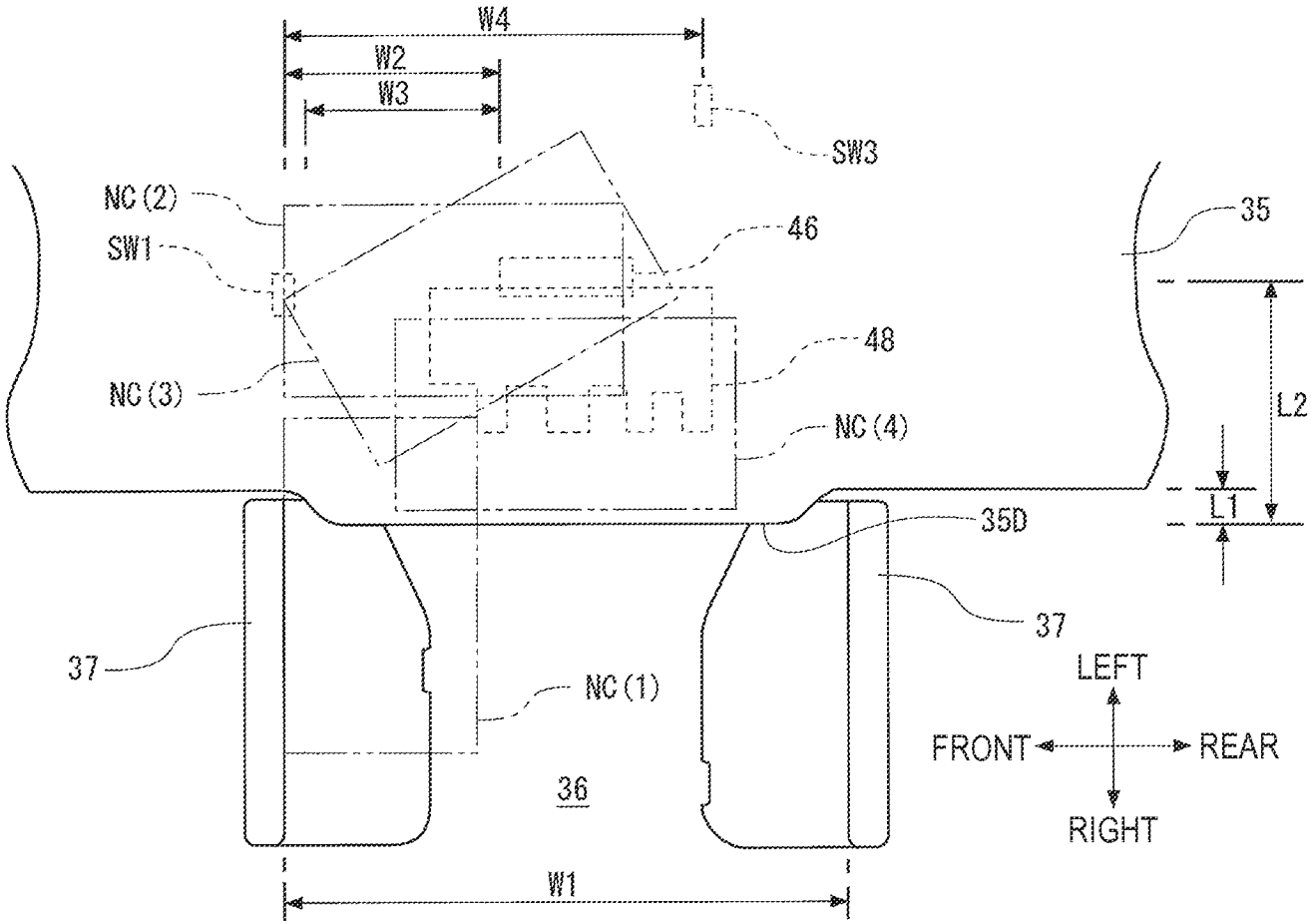
FIG. 8 is an explanatory view showing a relationship of arrangement of a first detection unit and a second detection unit of the sheet transport device.

Next, the relationship of arrangement of the front sensor SW1 and a rear sensor SW3 according to the illustrative embodiment will be described while referring to FIG. 8. In the description below, the minimum size of the sheet which can be transported by the sheet transport unit 30 is assumed to be the postcard size (100 mm×148 mm). Also, the shortest inner surface facing distance W1 between the sheet guides 37 is assumed to be the short side (100 mm) of the postcard. Further, there will be exemplified a case where a standard name card (55 mm×91 mm) which is a sheet smaller than the minimum sheet size (postcard size) is used to perform image reading. In FIG. 8, the front sensor SW1 and the rear sensor SW3 are arranged in a plan view for the convenience of illustration, and the dimensions (distance) are based on the center of each sensor.

In the sheet transport unit 30 according to the illustrative embodiment, the separation roller 46 and the front sensor SW1 are disposed to be separated from each other at least in the sheet width direction (front-rear direction) which is orthogonal to a predetermined transport direction of the sheet set on the sheet guide surface 36, and a distance W2 between the front sensor SW1 and an end edge of the separation roller 46 at a side of the front sensor SW1, that is, a front side end edge of the separation roller 46 is longer than a short side width W3 of a name card NC. The distance W2 is the straight-line distance in the front-rear direction orthogonal to the transport direction.

Herein, FIG. 8 assumes a case where the name card NC (1) is set toward the separation roller 46 such that a long side abuts onto the sheet guide 37 at the side where the front sensor SW1 is arranged, and the short side is arranged along the sheet width direction. In this case, even if the front sensor SW1 detects the setting of the sheet on the sheet guide surface 36 and the separation roller 46 is rotated by a user operation for the start of image reading, the name card NC (1) is not transported since the name card NC (1) is not in contact with the separation roller 46. In this manner, the transporting of the name card NC (1) may be prevented even in a case where the name card NC (1) which is smaller than the minimum sheet size is set on the sheet guide surface 36, and the separation roller 46 is driven.

Figure 7:
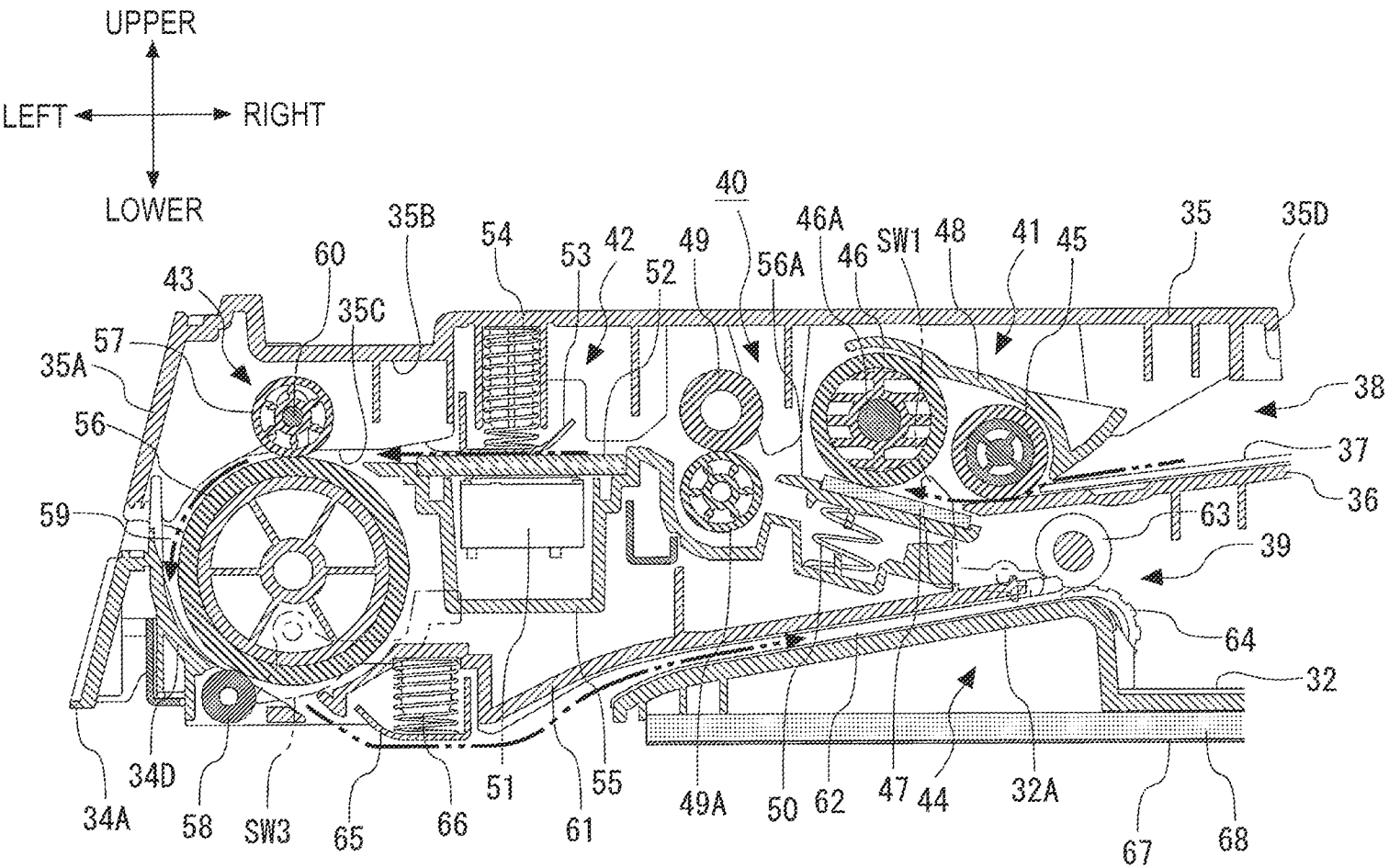
FIG. 7 is a cross-sectional view of a main part of a sheet transport portion of the sheet transport device.

Also, as shown in FIG. 7 and FIG. 8, the rear sensor SW3 is disposed at the transport direction downstream side than the separation roller 46 and at the opposite side of the front sensor SW1 in the sheet width direction with respect to the separation roller 46, and detects the sheet which is transported further toward the transport direction downstream side than the separation roller 46. In a plan view of the rear sensor SW3, a sheet width direction distance W4 from the front sensor SW1 is longer than the long side of the name card NC (2), and more specifically, longer than a diagonal line which is longer than the long side as shown in the name card NC (3) considering a case where so-called skew transport is performed.

Even if the front sensor SW1 detects the horizontal name card NC (2) which is set on the sheet guide surface 36 and the separation roller 46 transports the name card NC (2), the long side direction does not reach the rear sensor SW3 and the rear sensor SW3 does not detect the name card NC (2). At this time, in the illustrative embodiment, the driving of each of the rollers including the main transport roller 56 is stopped when the rear sensor SW3 does not detect the name card NC (2). Therefore, the name card NC (2) is not continuously transported toward the transport direction downstream side and the transporting of the name card NC (2) is stopped by the nip caused by the main transport roller 56 and the pinch roller 57 operating together. Accordingly, even if the transporting of the name card NC (2) is started by the separation roller 46, the transporting is stopped near the main transport roller 56. By opening the ADF cover 35 and opening the transport path near the main transport roller 56, that is, the upstream side path of the main transport roller 56 and the curved path 59, the name card NC (2) which is stopped at the upstream side of the transport path than the rear sensor SW3 may be easily taken out.

In this manner, even in a case where the sheet smaller than the minimum sheet size is set on the sheet guide surface 36 and the transporting of the sheet is started, the inconvenience that the sheet is transported toward the transport path further to the downstream side of the main transport roller 56 may be suppressed.

The main transport roller 56 integrally configures the U-turn transport path 59 which U-turns the transport direction of the sheet. Also, since the rear sensor SW3 is used also for determining the start timing of the reading by the movable reading sensor 25, the rear sensor is arranged at the downstream side of the U-turn transport path 59 near the movable reading sensor 25 which is at a stop position. Therefore, the ADF cover 35 has the upper panel portion 35A which is a portion on the left side surface of the sheet transport unit 30 in an integral manner such that the range including the U-turn transport path 59 at the upstream side than the rear sensor SW3 is opened when the ADF cover 35 is opened.

In the case of a relatively thick and firm sheet such as the name card NC (2), the sheet is unlikely to fall by its weight to the U-turn transport path 59. Therefore, if the distance from a nip portion between the main transport roller 56 and the pinch roller 57 to a nip portion between the main transport roller 56 and the pinch roller 58 is more separated than the short side W3 of the name card NC (2), the name card NC (2) which passes through the nip portion between the main transport roller 56 and the pinch roller 57 cannot reach the nip portion between the main transport roller 56 and the pinch roller 58 when the horizontal name card such as the name card NC (2) is set and transported. Accordingly, the transporting of the name card NC (2) to the downstream side of the main transport roller 56 may be suppressed.

An end portion of the ADF cover 35 at a side of the sheet feed inlet 38 has an end edge extending along the sheet width direction and formed with a projecting portion 35D at a center part thereof, which projects in a direction along the sheet guide surface 36 with respect to both end portions thereof.

It may be preferable that the projecting portion 35D is formed to be the range facing the separation roller 46, that is, the width of the separation roller 46 or wider. It may be more preferable that the projecting portion is formed to be wider than the range having the length (distance W4) corresponding to the long side of the small sheet which is a non-allowable sheet or longer from a position facing the rear sensor SW3. In the illustrative embodiment, the projecting portion 35D has approximately the same width as the inner surface facing distance W1 which is the shortest position at which the sheet guides 37 correspond to the sheet having the minimum sheet size. Also, the projecting length L1 of the projecting portion 35D is set such that the distance L2 between the projecting portion 35D and the nip portion of the separation roller 46 and the separation pad 47 is longer than the short side W3 of the name card NC (4).

Therefore, when the sheet is set from the sheet guide surface 36 to the separation roller 46, the setting of the small non-allowable sheet on the sheet guide surface 36 may be suppressed by the projecting portion 35D. Also, even if the sheet is forcibly set as in the case of the name card NC (4), it is difficult to set the name card NC (4) to reach the separation roller 46, and the transporting of the small non-allowable sheet may be suppressed. In the illustrative embodiment, the small non-allowable sheet is the name card NC, and the name card NC is set on the sheet guide surface 36. However, when a sheet larger in size than the name card NC is the small non-allowable sheet, there may be a case where the sheet is set from the sheet guide surface 36 across the sheet supporting surface 31A.

[Configuration of Control System]

The various driving systems installed in the main body unit 10, the reading unit 20, and the sheet transport unit 30 and the reading data are controlled by the control unit installed in the main body unit 10.

Figure 9:
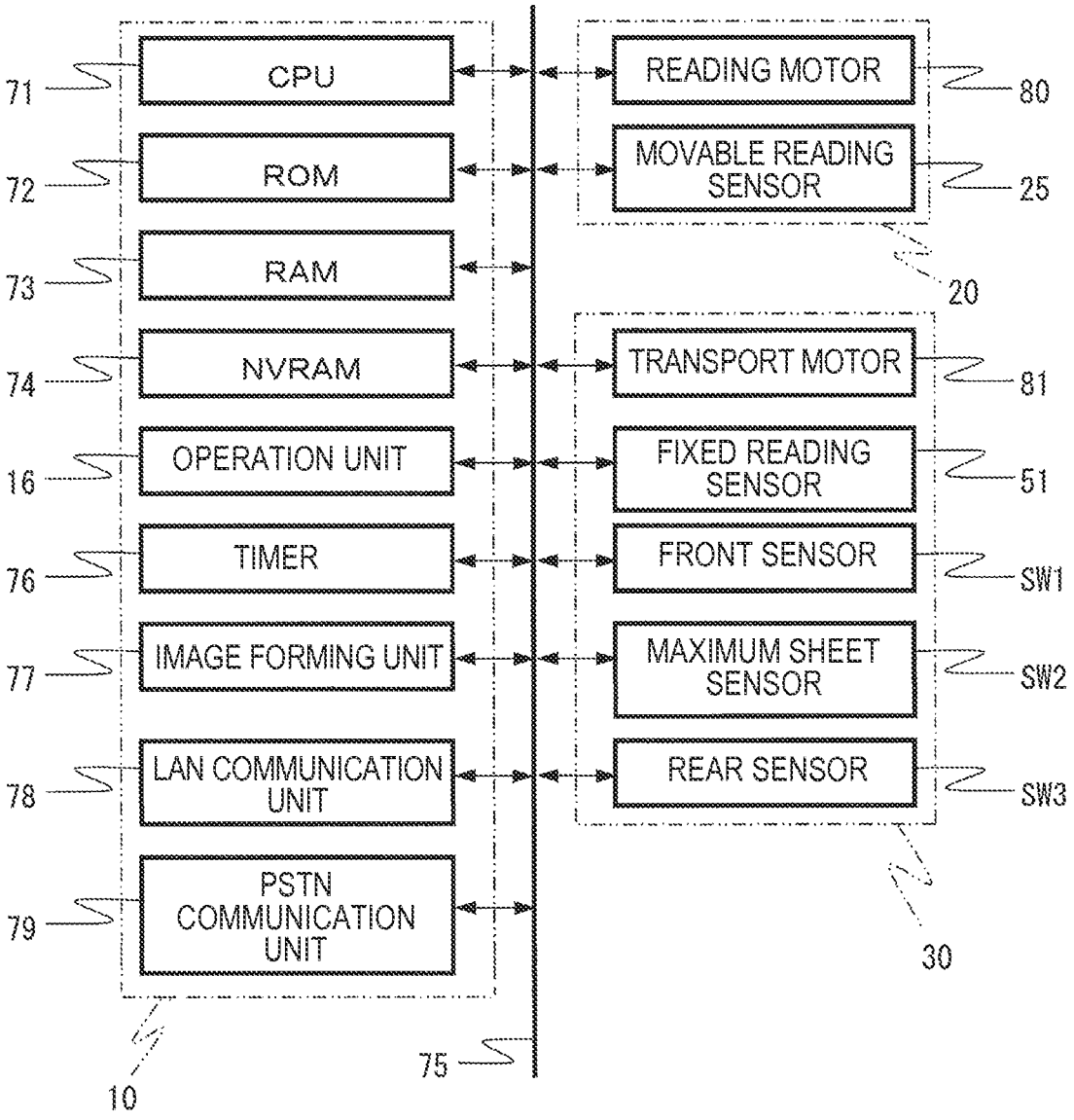
FIG. 9 is a block diagram of a control system of the multifunction printer mounted with the sheet transport device.

As shown in FIG. 9, the main body unit 10 includes a CPU 71, ROM 72, RAM 73, and NVRAM 74, and includes a timer 76, an image forming unit 77, a LAN communication unit 78, a PSTN communication unit 79 and the like in addition to the above-described operation unit 16 (including the liquid crystal display panel 15) via a bus 75.

The CPU 71 executes predetermined processing following a control program stored in the ROM 72, and executes control on each portion of the multifunction printer 1 based thereon. By arranging the CPU or the like in the reading unit 20 and the sheet transport unit 30 and performing comprehensive control on the main body unit 10 with the CPU, the unit exchange of the reading unit 20, versatility for the installation of an option on the sheet transport unit 30 or the like may be expanded.

The image forming unit 77 is received by the main body unit 10, and includes an electro-photographic or inkjet printing mechanism. The LAN communication unit 78 is configured to have a communication interface device corresponding to a wireless LAN and a communication interface device corresponding to a wired LAN. The PSTN communication unit 79 is configured to have various equipments necessary for public switched telephone network (PSTN) connection such as a fax modem and a voice codec.

The CPU 71 controls the driving of the movable reading sensor 25 of the reading unit 20 and a reading motor 80 which moves the movable reading sensor 25. The image data read by the movable reading sensor 25 is processed by an image processing circuit such as an analog front end (AFE) which is not shown and stored by, for example, the RAM 73 or the NVRAM 74. In the case of the copying function with which the read image data is copied, the stored data is processed by the image forming unit 77 to perform image forming processing on the recording sheet. The specific configuration and the description of the control related to the movement of the movable reading sensor 25 are omitted since known techniques may be employed therein. Also, the CPU 71 causes the movable reading sensor 25 to execute white reference correction or the like.

The CPU 71 executes the same processing as the above-described movable reading sensor 25 on the image data read by the fixed reading sensor 51 of the sheet transport unit 30, and controls the driving of a transport motor 81 which drives each of the rollers of the sheet transport portion 40. Also, the CPU 71 controls the driving of the transport motor 81 and the reading timing of each of the reading sensors 25 and 51 according to the detection results of the front sensor SW1, the maximum sheet sensor SW2, and the rear sensor (second detection unit) SW3.

[Sheet Transport Operation]

In the above-described configuration, the front sensor SW detects the setting of the sheets when the sheets having a size allowed to be transported by the sheet transport unit 30 according to the illustrative embodiment is appropriately set on the sheet supporting surface 31A across the sheet guide surface 36. When a reading start operation (scanning function or copying function) is made in this state, the sheets set on the sheet supporting surface 31A are drawn by the sheet feed roller 45, and the uppermost sheet of the sheets is separated by the separation roller 46 and the separation pad 47 operating together and is transported toward the relay roller pair 49.

The relay roller pair 49 transports the sheet which is transported toward downstream side. In a case of a double-sided reading, the image on the back surface side is read by the fixed reading sensor 51 when the sheet passes between the third platen 52 and the sheet pressing member 53. Also, in a case of a single-sided reading, the fixed reading sensor 51 does not perform the reading of the image and transports the sheet as it is toward the U-turn transport path 59.

In the U-turn transport path 59, the main transport roller 56 is driven and rotated, and transports the sheet to U-turn the sheet toward the downstream side by operating together with the pinch roller 57, the transport rib 35C, the guide surface 34D, and the pinch roller 58.

When the rear sensor SW3 detects the tip end of the sheet passing through the U-turn transport path 59, the image on the front surface side of the sheet is read by the movable reading sensor 25 when the sheet passes between the sheet pressing member 65 and the second platen 24. Further, the sheet after the reading of the image is transported toward the discharge unit 44, passes through the sheet discharge path 62 between the guide panel 61 and the lower guide panel portion 32A, and the sheet is discharged from the sheet discharge port 39 toward the sheet discharge tray 32 as the sheet discharge roller 63 and the pinch roller 64 operate together with each other.

Figure 10:
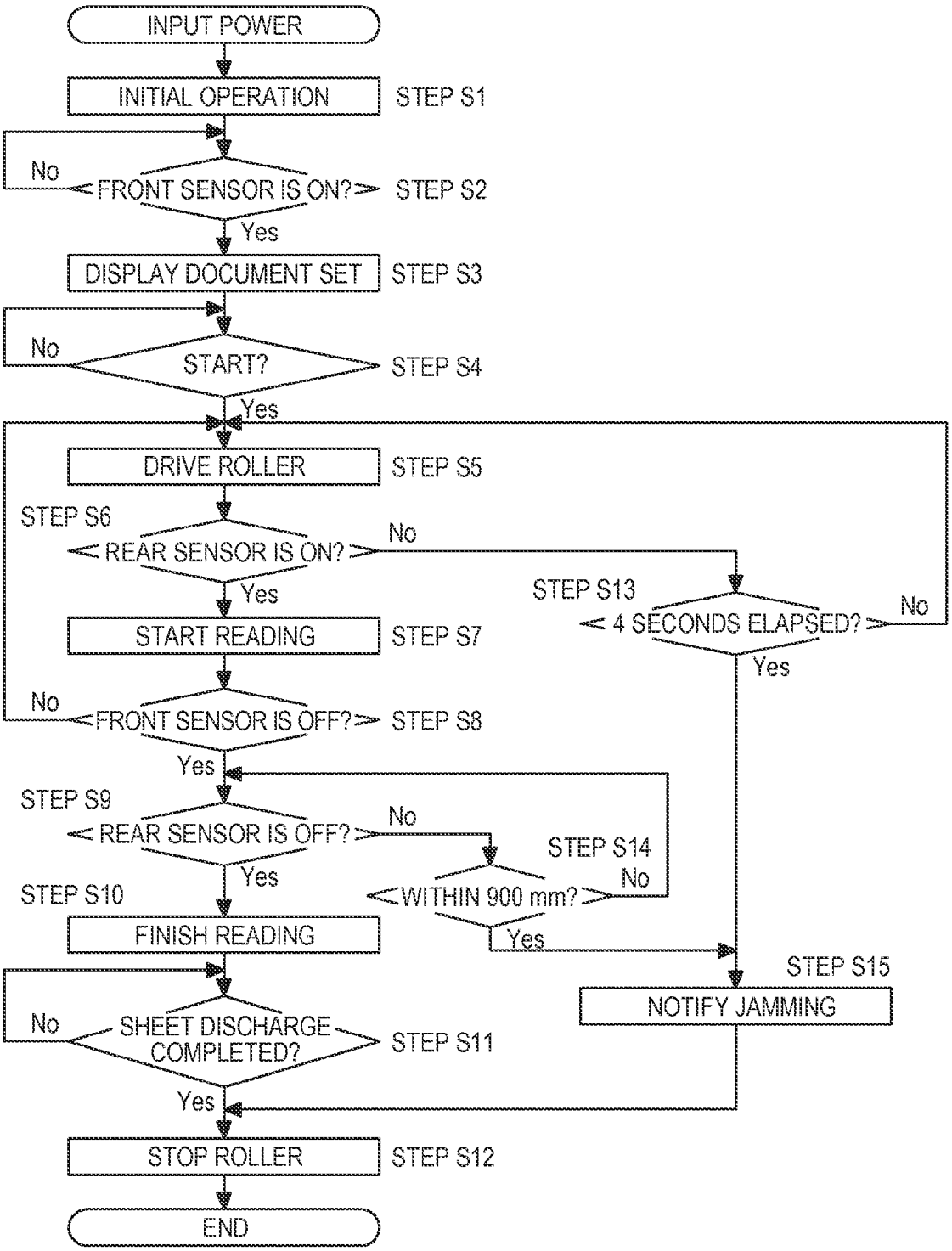
FIG. 10 is a flowchart of a control routine of a control unit according to the illustrative embodiment of the present invention.

Next, the processing executed by the CPU 71 when the sheet smaller than the minimum sheet size is set on the sheet guide surface 36 will be described while referring to the flowchart of FIG. 10.

When the main power (not shown) of the operation unit 16 is turned on, the CPU 71 performs initial operations such as the confirmation of the LAN connection by the LAN communication unit 78, the shading correction using white reference data and the like (step S1), and proceeds to step S2 in a standby state.

In step S2, the CPU 71 determines whether the sheet is set on the sheet guide surface 36 based on the detection by the front sensor SW1. When the front sensor SW1 detects the sheet, the process proceeds to step S3. When the front sensor SW1 does not detect the sheet, the routine continues to monitor whether the sheet is set.

In step S3, the CPU 71 displays that the sheet is set, on the liquid crystal display panel 15 or the like and proceeds to step S4. At this time, display is made to ask the user to select whether the reading of the sheet is to be performed on one side surface or both side surfaces and which mode (scanning mode, copying mode, and facsimile mode) is to be used. After the selection is made, the user is asked to enter the start operation to start the reading of the sheet.

In step S4, the CPU 71 monitors whether the mode necessary for the reading of the image on the sheet (scanning mode, copying mode, and facsimile mode) is selected and whether the reading start operation is made. When the reading start operation is made, the process proceeds to step S5. When the reading start operation is not made, the routine continues monitoring. Optionally, when a predetermined time between the detection of the sheet in step S2 and the operation in step S4 elapses, error notification, entering a sleep mode or the like may be made.

In step S5, the CPU 71 drives the sheet feed roller 45, the separation roller 46, the relay roller pair 49, and the main transport roller 56 by controlling the transport motor 81, and proceeds to step S6 by starting the transporting of the sheet.

In step S6, the CPU 71 monitors whether the rear sensor SW3 detects the sheet. When the rear sensor SW3 detects the sheet, the process proceeds to step S7. When the rear sensor SW3 does not detect the sheet, the process proceeds to step S13.

In step S7, the CPU 71 starts the reading of the image on the sheet by the movable reading sensor 25 and proceeds to step S8.

In step S8, the CPU 71 monitors whether the front sensor SW1 detects the trailing edge of the sheet. When the front sensor SW1 becomes off by transporting of the sheet, the transporting of all of the set sheets is finished and the process proceeds to step S9. When the front sensor SW is not off, the process returns to step S5 so as to continue the processing on the second and subsequent sheets.

In step S9, the CPU 71 monitors whether the rear sensor SW3 detects the trailing edge of the sheet. When the rear sensor SW3 is off by transporting of the sheet, the trailing edge of the sheet passes from the rear sensor SW3 and the process proceeds to step S10. When the sheet continues to be detected with the rear sensor SW3 remaining on, the process proceeds to step S14.

In step S10, the CPU 71 finishes the reading of the image on the sheet by the movable reading sensor 25 and proceeds to step S11.

In step S11, the CPU 71 monitors whether the sheet passes from the sheet discharge port 39 by a sheet discharge sensor which is not shown. When the sheet discharge is completed, the process proceeds to step S12. When the sheet discharge is not completed, the routine is continued to be monitored. When the sheet discharge sensor is turned from on to off in a state where the front sensor SW1 detects the sheet, the transporting of the subsequent sheets may be started if the second and subsequent sheets are present.

In step S12, the CPU 71 stops the driving of the transport motor 81 so as to stop the driving of the sheet feed roller 45, the separation roller 46, the relay roller pair 49, and the main transport roller 56, and finishes the processing.

When the rear sensor SW3 does not detect the sheet in step S6, the CPU 71 monitors in step S12 whether the count by the timer 76 exceeds four seconds from the start of the transporting of the sheet in step S4. When the count by the timer 76 exceeds four seconds, the CPU 71 proceeds to step S15. When the count by the timer 76 does not exceeds four seconds, the process proceeds to step S5 to continue the transporting of the sheet as assuming the sheet is being transported.

When the rear sensor SW3 detects the sheet in step S9, the CPU 71 monitors in step S14 whether the total sheet transport distance (including the second and subsequent sheets) is within 900 mm from the start of the transporting of the sheet in step S4. In other words, since the maximum sheet size by the sheet transport unit 30 according to the illustrative embodiment is A3 (long side is 420 mm), the fact that the rear sensor SW3 does not become off means not the normal transporting of the sheet even if two sheets of A3 sheets are transported without being separated. Therefore, the CPU 71 determines whether to transporting has been made perform 900 mm, and continues the transporting of the sheet by proceeding to step S9 if the distance is within 900 mm and proceeds to step S15 when the distance exceeds 900 mm.

In step S15, the CPU 71 performs jamming notification by the liquid crystal display panel 15 or the like if the determination result in step S13 or step S14 is abnormal as jamming of the sheet occurs, proceeds to step S12, and stops the driving of the transport motor 81.

According to this processing, when the rear sensor SW3 does not detect the sheet even if the front sensor SW1 detects the sheet and four seconds elapse after the start of the transporting of the sheet, the driving of the rollers is stopped and the transporting is stopped. At this time, the sheet is stopped at the upstream side of the transport path than the rear sensor SW3, and therefore, the sheet may be easily taken out by opening the ADF cover 35.

According to the above configuration, in the sheet transport unit 30 according to the illustrative embodiment, the front sensor SW1 is arranged to be more separated than the short side width W3 of the name card NC from the end edge of the separation roller 46, and the rear sensor SW3 is arranged to be more separated than the long side of the name card NC from the front sensor SW1. Therefore, the transporting of the name card NC which is smaller than the minimum sheet size may be suppressed, and, even if the sheet is transported, the transporting of the sheet is stopped at the upstream side than the rear sensor SW3 since the sheet is not detected by the rear sensor SW3. Accordingly, even in a case where the transporting of the sheet is started, the transporting of the sheet to a position where it is difficult for the sheet to be taken out may be suppressed or prevented.

While the present invention has been shown and described with reference to certain illustrative embodiments thereof, it will be understood by those skilled in the art that various changes in form and details may be made therein without departing from the spirit and scope of the invention as defined by the appended claims.

For example, in the above-described illustrative embodiment, the minimum sheet size of the sheet transport unit 30 is the postcard size (100 mm×148 mm), the shortest inner surface facing gap W1 of the sheet guide 37 is the short side (100 mm) of the postcard, and the distance W2 between the front sensor W1 and the end edge of the separation roller 46 at a side of the front sensor SW1 is longer than the short side width W3 of the name card NC. However, these settings are optional.

What is claimed is:

1. A sheet transport device comprising:

a sheet supporting surface configured to support one or more sheets thereon;

a separation roller configured to separate, one by one, the one or more sheets supported by the sheet supporting surface to transport a separated sheet in a predetermined transport direction;

a first detection unit disposed by the sheet supporting surface and configured to detect whether a sheet is set on the sheet supporting surface;

a second detection unit disposed at a downstream side of the separation roller in the transport direction and at an opposite side of the first detection unit in a sheet width direction with respect to the separation roller, and configured to detect a sheet which is transported toward a downstream side in the transport direction from the separation roller;

a cover configured to be displaceable between a closed position and an opened position; and a transport roller disposed at a downstream side of the separation roller in the transport direction, and configured to transport a sheet separated by the separation roller in the transport direction, wherein the sheet supporting surface comprises a movable sheet guide configured to regulate a position of a sheet in the sheet width direction orthogonal to the predetermined transport direction, the movable sheet guide comprising two sheet guide members, and a distance between the sheet guide members being changeable between a first distance where the sheet guide members are closest to each other and a second distance which is larger than the first distance, wherein the first detection unit is disposed on an extension line of a guide surface of one of the sheet guide members in a state where the distance between the sheet guide members is the first distance, wherein the transport roller configures a curved path to transport the separated sheet further downstream while turning in the transport direction, wherein the second detection unit is disposed at a downstream side of the curved path, and wherein when the cover is at the opened position, the curved path which is at an upstream side of the second detection unit is uncovered.

2. The sheet transport device according to claim 1, wherein the cover is configured to cover the separation roller, and wherein the cover comprises an end edge extending along the sheet width direction, the end edge comprising a projecting portion at a center portion in the sheet width direction, the projecting portion projecting in a direction along the sheet supporting surface with respect to both end portions thereof in the sheet width direction.

3. The sheet transport device according to claim 2, wherein the projecting portion is formed in a range facing the separation roller.

4. The sheet transport device according to claim 1, wherein the cover is configured to cover the separation roller, and wherein the cover comprises an end edge projecting in a direction along the sheet supporting surface in a range corresponding to an inner area of the sheet guide when the distance between the sheet guide members is the first distance.

5. The sheet transport device according to claim 1, wherein when the cover is at the opened position, the curved path which is at the upstream side of the second detection unit and a transport path which is at an upstream side of the transport roller are uncovered.

6. The sheet transport device according to claim 1, wherein the transport roller is configured by a single roller, and an outer circumferential surface of the transport roller defines the curved path, and wherein the second detection unit is disposed at the downstream side of the curved path so as to contact the sheet which is transported along the outer circumferential surface of the transport roller.

7. The sheet transport device according to claim 1, wherein the cover is configured to be displaceable between a position covering the separation roller and a position not covering the separation roller, and wherein the cover comprises an end edge projecting in a direction along the sheet supporting surface at a range corresponding to the first distance.

8. The sheet transport device according to claim 1, further comprising:

a driving unit configured to drive the transport roller; and a control unit configured to perform control to stop driving the transport roller when the sheet is not detected by the second detection unit after a predetermined time elapses from the first detection unit detecting the sheet.

9. A sheet transport device comprising:

a sheet supporting surface configured to support one or more sheets thereon;

a separation roller configured to separate, one by one, the one or more sheets supported by the sheet supporting surface to transport a separated sheet in a predetermined transport direction;

a first detection unit disposed by the sheet supporting surface and configured to detect whether a sheet is set on the sheet supporting surface;

a second detection unit disposed at a downstream side of the separation roller in the transport direction and at an opposite side of the first detection unit in a sheet width direction with respect to the separation roller, and configured to detect a sheet which is transported toward a downstream side in the transport direction from the separation roller;

a pair of movable sheet guides configured to regulate a position of a sheet in a sheet width direction;

a cover configured to cover the separation roller and to be displaceable between a closed position and an opened position; and a transport roller disposed at a downstream side of the separation roller in the transport direction, and configured to transport a sheet separated by the separation roller in the transport direction, wherein a distance between the movable sheet guides is changeable between a first distance where the movable sheet guides are closest to each other and a second distance which is larger than the first distance, wherein the first detection unit is disposed on an extension line of a guide surface of one of the sheet guides in a state where the distance between the sheet guides is the first distance, wherein the cover comprises an end edge located at an upstream side in the transport direction, the end edge comprising a projecting portion projecting from a center portion thereof in the sheet width direction, in a direction along the sheet supporting surface and located between the pair of the movable sheet guides in a state where the distance between the movable sheet guides is the first distance, wherein the transport roller configures a curved path to transport the separated sheet further downstream while turning in the transport direction, wherein the second detection unit is disposed at a downstream side of the curved path, and wherein when the cover is at the opened position, the curved path which is at an upstream side of the second detection unit is uncovered.

* * * * *